United States Patent [19]

Suzuki et al.

[11] 3,985,435

[45] Oct. 12, 1976

[54] COLOR ELECTROPHOTOGRAPHIC APPARATUS

[75] Inventors: Shigeru Suzuki; Nobuo Kasahara, both of Yokohama; Nobuyuki Katagiri, Tokyo, all of Japan

[73] Assignee: Ricoh Co., Ltd., Tokyo, Japan

[22] Filed: July 24, 1975

[21] Appl. No.: 598,727

Related U.S. Application Data

[62] Division of Ser. No. 422,790, Dec. 7, 1973, abandoned.

[30] Foreign Application Priority Data

Dec. 29, 1972 Japan ..... 48-3733

[52] U.S. Cl. ..... 355/4; 355/16

[51] Int. Cl.[2] ..... G03G 15/01

[58] Field of Search ..... 355/3 TE, 4, 16, 3 TR, 355/3 DR, 3 R, 64, 65, 8, 11

[56] References Cited

UNITED STATES PATENTS

| | | | |
|---|---|---|---|
| 3,190,199 | 6/1965 | Clark | 242/71.6 |
| 3,531,195 | 9/1970 | Tanaka et al. | 355/4 |
| 3,694,069 | 9/1972 | Yamaji et al. | 355/4 |
| 3,734,607 | 5/1973 | Davis et al. | 355/4 |
| 3,771,866 | 11/1973 | Ogawa | 355/16 X |
| 3,797,930 | 3/1974 | Tanaka et al. | 355/4 |

*Primary Examiner*—Joseph F. Peters, Jr.
*Assistant Examiner*—Kenneth C. Hutchison
*Attorney, Agent, or Firm*—Cooper, Dunham, Clark, Griffin & Moran

[57] ABSTRACT

An electrophotographic photoreceptor is moved in reciprocatory movements at least a number of times corresponding to the number of color-selective reflection and transmission filters in a predetermined zone in which are disposed an exposing station and a transfer printing station. The electrophotographic photoreceptor is electrically charged and exposed to an optical image of the original during its reciprocating movements, with the color-selective reflection and transmission filters used varying from one reciprocating movement to another. An electrostatic latent image formed on the photoreceptor is printed by transfer printing on a transfer printing sheet by bringing the latter into contact with the former each time such image is formed, and the latent image is converted into a visible image by using a specific developing liquid of a color corresponding to the color-selective reflection and transmission filter used for forming the latent image. The photoreceptor is repeatedly processed through the charging, exposing, electrostatic latent image transfer printing and developing steps so as to build up on the same transfer printing sheet visible images of colors for the respective color-selective reflection and transmission filters whereby a color duplicate of the original can be produced.

7 Claims, 14 Drawing Figures

COLOR ELECTROPHOTOGRAPHIC APPARATUS

This application is a division of application Ser. No. 422,790 filed Dec. 7, 1973, now abandoned.

BACKGROUND OF THE INVENTION

This invention relates to color electrophotographic apparatus, and more particularly it is concerned with a novel color electrophotographic apparatus of the type wherein an electrophotographic photoreceptor is moved in reciprocatory movements between an exposing station and a transfer printing station, and an electrostatic latent image is formed on the photoreceptor and printed on a transfer printing sheet and developed each time the photoreceptor makes one reciprocating movement.

The most important thing in producing a good picture in color electrophotography is to prevent occurrence of misregistration of images when color-selective reflection and transmission filters are used for projecting images and then developing such images in a series of operations. It has hitherto been customary to use a photosensitive drum, for example, which is made to rotate continuously so that charging, exposing, developing and transfer printing may be performed during its rotation. The use of such rotary photosensitive drum has posed the problem of how to synchronize the rotation of the drum with the movement of the optical system. In order to obviate this problem, it has been necessary to use a mechanism of complex structure which has inevitably raised the cost of production.

On the other hand, in another type of color electrophotography known in the art, one photoreceptor is used and subjected to a series of charging, exposing and developing operations. In this system, charging and exposing are performed on the photoreceptor to form an electrostatic latent image on the photoreceptor on which a toner image has already been formed. This system has a disadvantage in that the sensitivity of the photoreceptor is reduced by the presence of the toner image, with the result that the electrostatic latent image formed in the next series of charging, exposing and developing operations leaves much to be desired. Another disadvantage of this system is that since a toner image is formed on the photoreceptor, it is essential that the photoreceptor be cleaned, and the cleaning of the photoreceptor leads to a short service life.

SUMMARY OF THE INVENTION

This invention has as its object the provision of a novel color electrophotographic apparatus which obviates the aforementioned disadvantages of the prior art.

According to the invention, there is provided a color electrophotographic apparatus wherein a photoreceptor moves in reciprocating motion in a predetermined zone and the starting position of the photoreceptor is constant at all times, so that misregistration of various color images on the photoreceptor can be prevented.

According to the invention, it is only the electrostatic latent image that is formed on the photoreceptor and this eliminates the disadvantage of the surface of the photoreceptor being damaged by cleaning. The electrostatic latent image is printed by transfer printing on the dielectric layer of a transfer printing sheet. Since toner particles applied to the dielectric layer of the transfer printing sheet are of substantially the same nature as the dielectric layer, there is no danger of the dielectric layer being damaged by the application of toner particles.

The apparatus according to the invention is high in efficiency, because charging of the photoreceptor can be effected during its return movement to the starting position or during a period in which the photoreceptor would otherwise be idling.

DESCRIPTION OF A PREFERRED EMBODIMENT

The mechanism used for moving the photoreceptor in reciprocating motion and bringing a transfer printing sheet into contact therewith will be first described with reference to FIG. 1 to FIG. 9.

Figure 1:
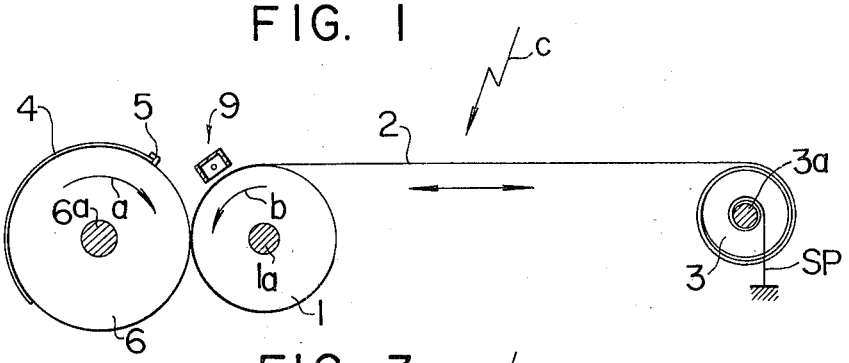
FIG. 1 to FIG. 9 are schematic views in explanation of various mechanisms for moving the photoreceptor in reciprocating motion and bringing a transfer printing sheet into contact therewith according to the invention.

In FIG. 1, a photoreceptor drive roller 1 has secured thereto one end of an electrophotographic photoreceptor 2 which is wound on to rewind roller 3 at the other end. A spiral spring SP is mounted between the roller 1 and a shaft 1*a* supporting the roller 1 so that the roller 3 may tend to urge the photoreceptor 2 to be wound thereon. Alternatively, the photoreceptor 2 may be trained over the roller 3 and then pulled by a coil spring.

The photoreceptor 2 is of belt form and comprises a supporter made as of polyester film and rendered electrically conductive by depositing aluminum thereon in vacuum, the supporter being formed thereon with a layer of zinc oxide, selenium, poly-N-vinyl carbazole or other photoconductive material.

Maintained in intimate contact with the periphery of the photoreceptor drive roller 1 is a transfer printing roller 6 having a transfer printing sheet 4 secured to its periphery by means of a clamp member 5. The transfer printing roller 6 which rotates while carrying the transfer printing sheet 4 thereon constitutes a transfer printing station.

Figure 2:
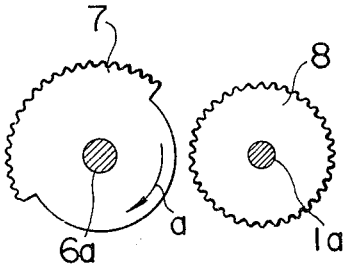
Figure 5:
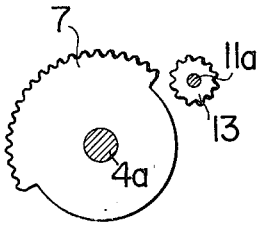

As shown in FIG. 2, the roller 6 is supported by a shaft 6*a* having a sector gear 7 affixed thereto, while the roller 3 has a gear 8 affixed to its shaft 3*a*. The rollers 1 and 6 can be made to rotate in the directions of arrows *b* and *a* respectively by bringing the sector gear 7 into meshing engagement with the gear 8 when the shaft 6*a* of roller 6 is rotated in the direction of the arrow *a*.

Upon rotation of roller 1 in the directions of the arrow *b*, a predetermined portion of the photoreceptor 2 is wound on the roller 1 and moves leftwardly from its starting position in FIG. 1, and at the same time roller 6 rotates and the transfer printing sheet 4 on the periphery of roller 6 also moves while being maintained at its surface in intimate contact with the surface of the predetermined portion of the photoreceptor 2.

As the shaft 6*a* supporting roller 6 continuously moves in the direction of arrow *a*, the sector gear 7 is brought out of meshing engagement with the gear 8, thereby releasing roller 1 and permitting the photoreceptor 2 to be rewound on roller 3 by moving rightwardly in returning movement in FIG. 1.

Disposed leftwardy upwardly of roller 1 in FIG. 1 is a charging device 9 which is rendered operative as when the photoreceptor 2 is rewound on roller 3 to thereby electrically charge the photoreceptor 2. The photoreceptor 2 has its predetermined portion exposed to an optical image of an original by using one of three color-selective reflection and transmission filters at an exposing station designated *c* when the photoreceptor 2 is completely rewound on roller 3, whereby an electrostatic latent image can be formed on the predetermined portion of the photoreceptor 2. The exposing operation may be performed during the time the photoreceptor 2 moves leftwardly in FIG. 1 from roller 3 to roller 1. If this is the case, a slit exposing device is employed.

The electrostatic latent image formed on the predetermined portion of the photoreceptor 2 is printed by transfer printing on the transfer printing sheet 4 which is brought into intimate contact with the photoreceptor 2 through roller 6. The transfer printing sheet 4 comprises a supporter made of paper or polyester, and a dielectric layer formed by applying a copolymer of vinyl chloride and vinyl acetate or a copolymer of vinyl chloride and crotonic acid. An electrostatic latent image can be printed on a transfer printing sheet by transfer printing by bringing its dielectric layer into intimate contact with the electrostatic latent image.

As soon as an electrostatic latent image is formed on the transfer printing sheet 4, the image is developed into a visible toner image by using a dry or wet developing agen comprising toner particles of a color corresponding to the filter used. Rollers 1 and 6 are rotated at least a number of times corresponding to the number of the color-selective reflection and transmission filters used, and the photoreceptor 2 makes a series of reciprocating movements corresponding in number to the colorselective reflection and transmission filters used being charged and exposed in each reciprocating movement. The transfer printing copy sheet 4 remains wound on roller 6 while the latter rotates continuously, so that an electrostatic latent image is printed thereon and developed each time roller 6 rotates. As a result, color images are built up on the transfer printing sheet 4 to produce a desired color duplicate of the original.

Figure 3:
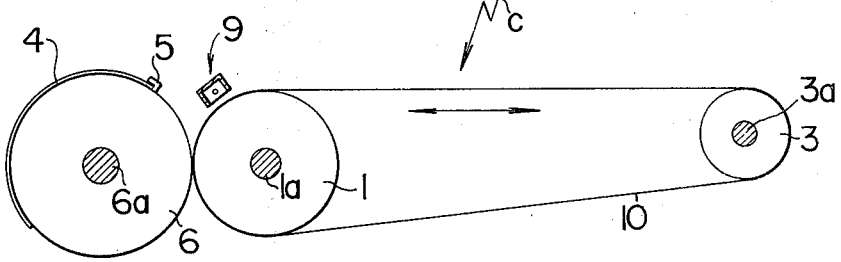

In FIG. 3, there is shown a photoreceptor 10 in the form of an endless belt in place of the photoreceptor 2 of the belt form shown in FIG. 1. The endless belt 10 is also moved in a series of reciprocating movements. The use of an endless belt as a photoreceptor offers the advantage of alternately using its upper run and its lower run as a predetermined portion for forming an electrostatic latent image thereon by remounting the endless belt when its photosensitive layer is degenerated as the result of fatigue.

Figure 4:
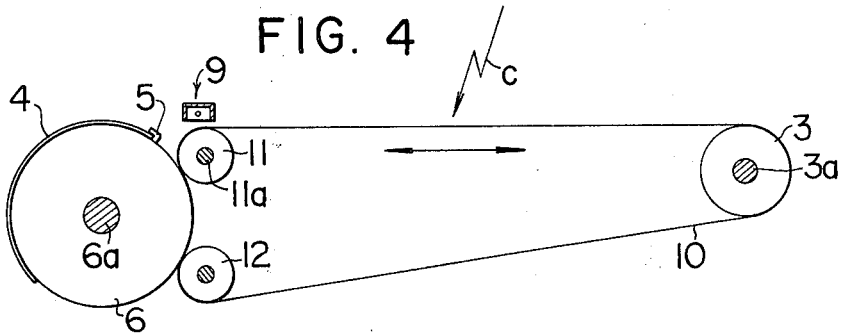

FIG. 4 shows a mechanism in which two small rollers 11, 12 are used in place of the photoreceptor drive roller 1 to increase the area in the transfer printing station in which the photoreceptor is brought into intimate contact with the transfer printing sheet. In this arrangement, the sector gear 7 (FIG. 5) is adapted to mesh with a gear 13 affixed to a shaft 11*a* supporting the drive roller 11.

Figure 6:
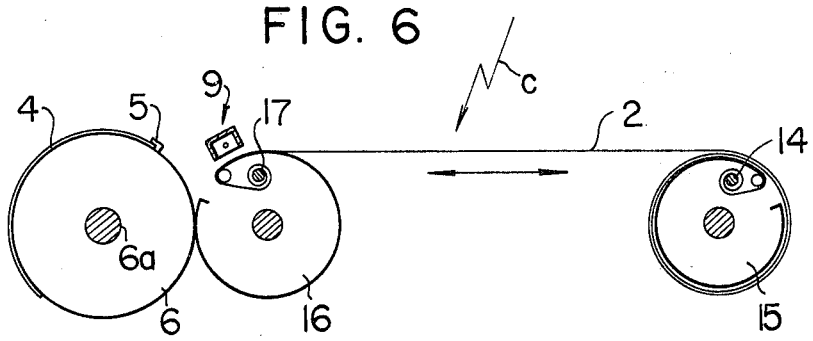

In the mechanism shown in FIG. 6, a roller 14 on to which the photoreceptor 2 is wound is mounted inside a drum-shaped rewind roller 15, and a drum-shaped photoreceptor drive roller 16 has mounted in the interior thereof a photoreceptor rewind roller 17. This arragement permits a fresh portion of the photoreceptor 2 to be withdrawn for use when the portion being used is degenerated as the result of fatigue.

Figure 7:
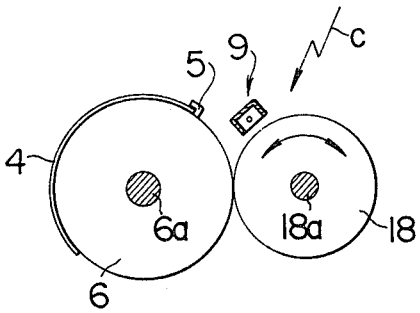

If the photoreceptor 2 is of the belt shape as aforementioned, the arragement is convenient because the photoreceptor can be made to lie in planar form when it is disposed in the exposing station. However, when exposing is effected by using a slit exposing system, the photoreceptor 2 may be mounted on the periphery of a drum-shaped supporter made as of aluminum as shown in FIG. 7 so that the photoreceptor 2 may be used in the form of a photosensitive drum 18. When this is the case, the drum can be made to tend to rotate rightwardly in FIG. 7 by mounting a helical spring between the drum 18 and its supporting shaft 18*a*. The drum 18 is driven to rotate in the same manner as described with reference to FIG. 2.

Figure 8:
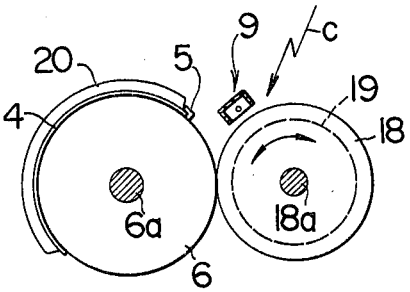
Figure 9:
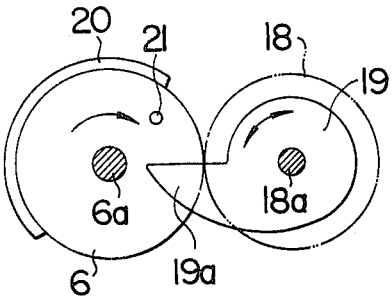

In the mechanism shown in FIG. 8, a friction wheel 19 is mounted on the shaft 18*a* supporting the photosensitive drum 18, while a sector friction wheel 20 is mounted on the shaft 6*a* supporting the transfer printing roller 6. Rotation of the shaft 6*a*supporting the transfer printing roller 6 frictionally drives the photosensitive drum 18 through friction wheels 20, 19 in frictional engagement with each other.

In this case, it may be difficult for friction wheels 19, 20 to provide a sufficiently high frictional force to drive the phtosensitive drum 18 in the initial stages of engagement of friction wheel 20 with friction wheel 19 because the area of contact is small. To avoid this disadvantage, a pin 21 (FIG. 9) may be affixed to friction wheel 20 and an arm 19*a* is formed on friction wheel 19, so as to start the movement of the photosensitive drum 18 by virtue of the pin 21 pushing and moving the arm 19*a* at the initial stages of engagement of friction wheel 20 with friction wheel 19.

The color photographic apparatus comprising one embodiment of the invention based on the principles embodied in the mechanisms shown in FIG. 1 will now be described with reference to FIG. 10 to FIG. 14.

Figure 10:
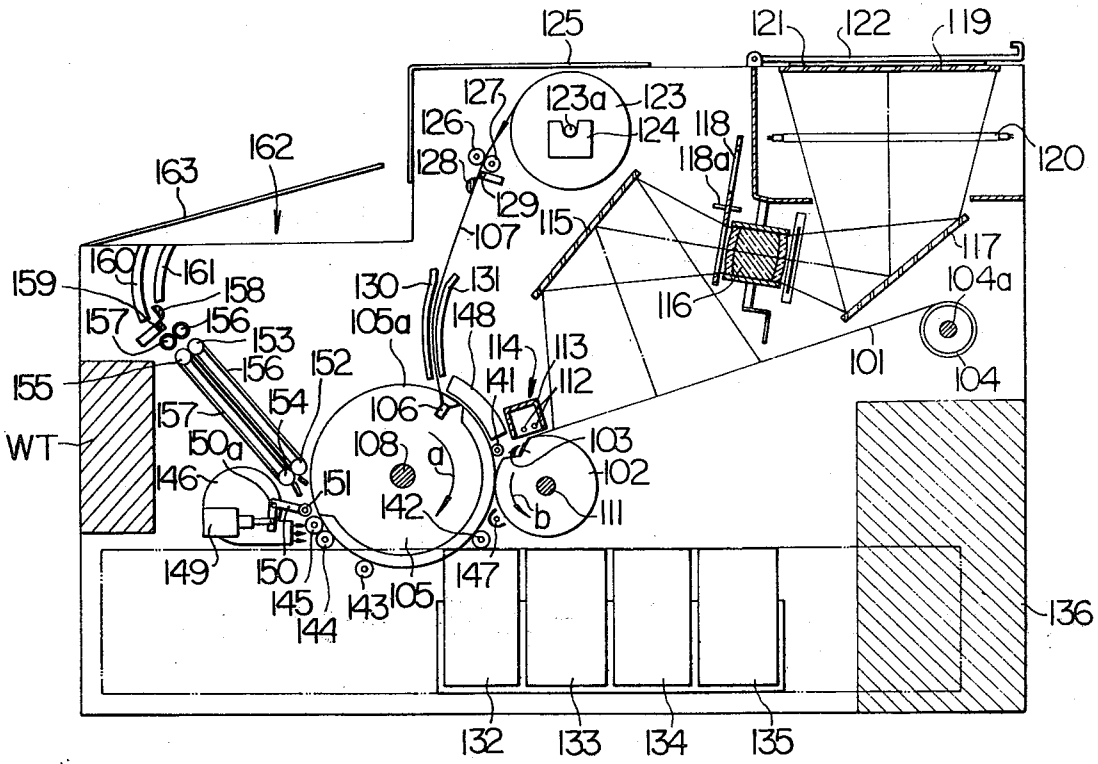
FIG. 10 is a side view of the color electrophotographic apparatus comprising one embodiment of the invention.

In FIG. 10, an electrophotographic photoreceptor 101 is secured at one end to a mount 103 disposed on the peripheral surface of a photoreceptor drive roller 102 and secured at the other end to a rewind roller 104 supported by a shaft 104*a*. A helical spring is mounted between the shaft 104*a* and the rewind roller 104 to urge the photoreceptor to be wound on the rewind roller 104.

Disposed leftwardly of the photoreceptor drive roller 102 in FIG. 10 is a transfer-printing roller 105 formed therein with a major diameter portion serving as a transfer-printing copy sheet support portion 105*a*. When a transfer printing sheet 107 is fed to the support portion 105*a*, the leading end of the transfer printing sheet 107 is fixed in place by a clamp member 106 so as to bring the transfer printing sheet 107 into pressing engagement with the photoreceptor 101 between the transfer printing roller 105 and the photoreceptor drive roller 102. The transfer printing sheet 107 is not fed to the transfer printing roller 105 during its first revolution.

Figure 12:
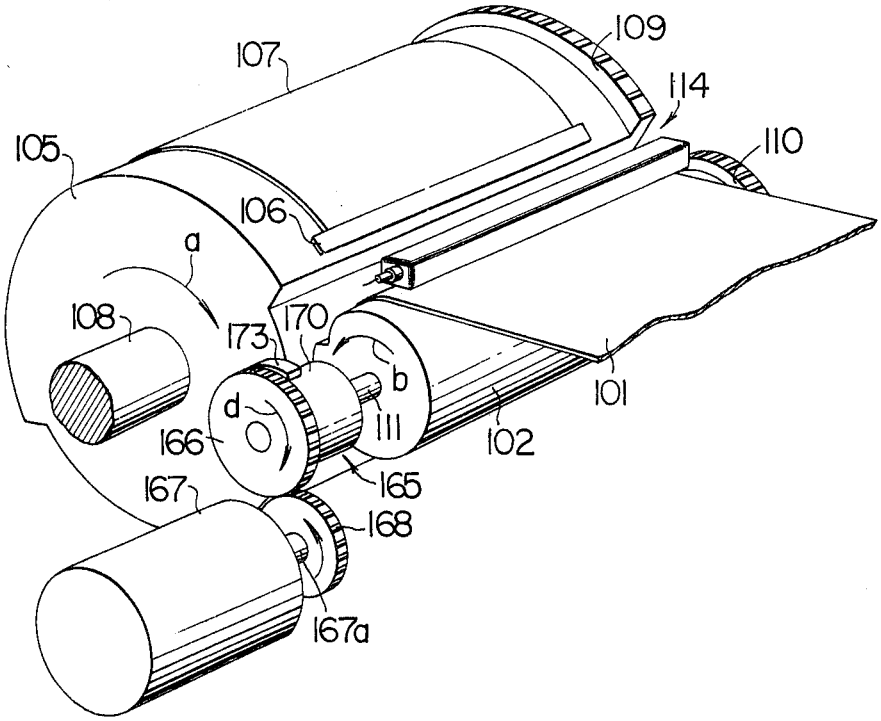
FIG. 12 is a perspective view of the means for controlling the rate of return movement of the photoreceptor.

The transfer printing roller 105 is supported by a shaft 108 connected by suitable means to a drive source (not shown) to rotate the transfer printing roller 105 at a constant rate in the direction of an arrow *a*. The transfer printing roller 105 has a sector gear 109 mounted thereon to act as a unit with the roller 105 as shown in FIG. 12 and maintained in meshing engagement with a gear 110 formed integrally with the photoreceptor drive roller 102.

Assuming that the transfer printing roller 105 rotates in the direction of the arrow *a* in FIG. 10 without the transfer printing sheet 107 being fed thereto, the photoreceptor drive roller 102 will rotate in the direction of an arrow *b* by virtue of gear 110 meshing with sector gear 109, so that the photoreceptor 101 also moves in the direction of the arrow *b*. When sector gear 109 is released from engagement with gear 110, the photoreceptor drive roller 102 is released and able to rotate freely. Then, the photoreceptor 101 is moved back to its starting position by the action of the rewind roller 104, with the photoreceptor drive roller 102 rotating in slaved relationship.

A charging device 114 comprising a wire electrode 112 and a shield 113 therefor is disposed obliquely leftwardly of the photoreceptor drive roller 102 in FIG. 10. A photoconductive material layer of the photoreceptor 101 is charged uniformly by the charging device 114 as the photoreceptor 101 moves back to its original position.

An exposing station is disposed above the photoreceptor 101 between the two rollers 102 and 104. In the exposing station, there are disposed an inclined mirror 115, projection lens 116, inclined mirror 117 and color-selective reflection and transmission filters 118 supported by a shaft 118*a* which cooperate with one another to expose the charged photoconductive material layer of the photoreceptor 101 to an optical image of an original 121 resting on a transparent original support 119 and illuminated by a light source or lamp 120. The original 121 is held in place by a keep plate 122.

The lamp 120 is turned on when the charged photoreceptor 101 completes its return movement to its original position, so that the photoreceptor 101 is exposed to an optical image of the original 121 in its entirety. Upon completion of an exposing operation, an electrostatic latent image of the original 121 is formed on the photoreceptor 101. A blue light transmitting filter is employed in the first exposing operation.

The transfer printing sheet 107 is fed to the transfer printing roller 105 about the time the photoreceptor 101 is exposed to an optical image of the original 121. A transfer printing strip in roll form 123 supported by a shaft 123*a* secured to a mount 124 is disposed obliquely rightwardly upwardly of the transfer printing roll 105 in FIG. 10, and one transfer printing sheet after another is supplied from the roll 123. The roll 123 can be replaced by a new roll by opening a cover 125.

The transfer printing strip paid out of the roll 123 is nipped by a pair of feed rollers 126, 127, moved between a pair of cutters 128, 129, guided by guide plates 130, 131 and fed to a portion of the transfer printing roller 105 in which the clamp 106 is disposed.

As the leading end of the transfer printing strip fed by the action of the feed rollers 126, 127 reaches the clamp 106, the latter is actuated by a cam or the like to grip the leading end of the strip. The cutters 128, 129 cut the strip at a suitable time to provide a transfer printing sheet 107 of a predetermined length. Upon the leading end of the transfer printing sheet 107 being gripped by the clamp 106 to mount the sheet on the periphery of the transfer printing roller 105, the latter starts its second revolution. This causes the photoreceptor drive roller 102 to rotate to move the photoreceptor 101 from the rewind roller 104 toward the drive roller 102, so that the transfer printing sheet 107 on the periphery of the transfer printing roller 105 is brought into intimate contact with the photoreceptor 101. Thus, the electrostatic latent image on the photoreceptor 101 is printed by transfer printing on the transfer printing sheet 107.

Four developing tanks 132, 133, 134 and 135 containing therein yellow, magenta, cyan blue and black developing liquids in the indicated order are disposed on the lower right side of the transfer printing roller 105. The tanks are moved leftwardly by rails or other suitable conveyor means and successively delivered to a position disposed below the transfer printing roller 105 each time the latter makes one revolution. The movement of the developing liquid tanks is effected by a controller 136 disposed on the lower right side of the apparatus.

Figure 14:
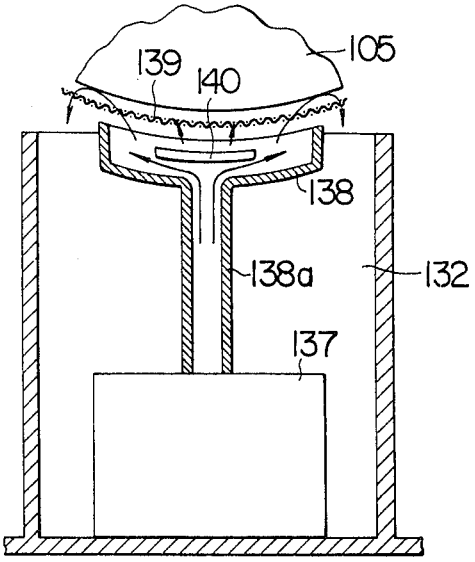
FIG. 14 is a sectional view of one form of developing device.

The developing tanks 132, 133, 134 and 135 each have a developing tray 138 disposed in the interior and connected to a pump 137 through a pipe 138*a* as shown in FIG. 14 with respect to the developing tank 132. A wire netting 139 is mounted above the developing tray 138, and a baffle plate 140 is mounted in the interior of the tray 138 and above the opening of the pipe 138*a*, so as to deliver the developing liquid upwardly while reducing the force of streams (shown by arrows) of the developing liquid by the baffle plate 140.

The pump 137 is actuated when the transfer printing sheet 107 is placed on the developing tray 138 by the rotating transfer printing roller 105 after an electrostatic latent image is formed on the transfer printing sheet 107, so that the developing liquid in the tank is supplied through the wire netting 139 to the transfer printing sheet 107 to develop the electrostatic latent image into a visible toner image. The first developing operation is performed by using a yellow developing liquid corresponding to the blue color transmitting filter which is contained in the developing liquid tank 132.

By referring to FIG. 10 again, keep rollers 141, 142 are mounted in the vicinity of the peripheral surface of the transfer printing roller 105 to prevent the drooping of the trailing end of the transfer printing sheet 107 which is not fixed. A squeeze roller 143 and blotter rollers 144, 145 are also mounted in the vicinity of the peripheral surface of the transfer printing roller 105 so as to dry the developed transfer printing sheet 107. Disposed leftwardly of the transfer printing roller 105 is a blower 146 which blows a wind against the developed transfer printing sheet 107 so that the developed image may be fixed and dried quickly.

Upon completion of drying of the developed transfer printing sheet 107 by the blower 146, the transfer printing roller 105 starts its third revolution. During the time the transfer printing sheet 107 is developed and dried, the photoreceptor drive roller 102 released from engagement with the transfer printing roller 105 moves the photoreceptor 101 back to its starting position, so that the charge on the photoreceptor 101 is removed by a degeneration precluding member 147 disposed leftwardly of the transfer printing roller 105 and then charged and exposed for the second time. Thus, by the time the transfer printing roller 105 starts its third revolution, another electrostatic latent image is already formed on the photoreceptor 101. In the second exposing operation, a green light transmitting filter is used, and an infrared ray lamp, for example, is used as the degeneration precluding member 147.

Upon the transfer printing roller 105 starting its third revoluton, a charging device 148 disposed obliquely rightwardly upwardly of the transfer printing roller 105 is rendered operative first thoroughly to charge the transfer printing sheet 107 by applying thereto a corona discharge of the opposite polarity of the electrostatic latent image to be formed on the transfer printing sheet 107 and then to reduce the potential on the transfer printing sheet 107 to almost zero by applying thereto another corona discharge of the opposite polarity to the first corona discharge. The charging device 148 is intended to preclude deleterious effects on the formation of the next toner image which the residual potential might otherwise have on the toner image formation. The charging device 148 may be replaced by other suitable means, e.g. means relying on an alternating current for charging the transfer printing sheet.

Further rotation of the transfer printing roller 105 results in another electrostatic latent image being formed on the transfer printing sheet 107 by transfer printing from the photoreceptor 101 and developed in the same manner as described with the first developing operation. In the developing operation, the electrostatic latent image on the transfer printing sheet 107 is developed by using a magenta developing liquid into a visible latent image.

When the transfer printing roller 105 makes its forth revolution, a red color transmitting filter is used and a toner image is formed on the transfer printing sheet 107 by using a cyan blue developing liquid. On fifth revolution of the transfer printing roller 105, a transparent filter is used or no filter is used in performing a exposing operation, and a graduation adjusting toner image is formed on the transfer printing sheet 107 by using a black developing liquid. This step may be eliminated. Thus, toner images of different colors are built up on the transfer printing sheet as the transfer printing roller 105 makes a total of five revolutions, whereby a color duplicate of the original can be produced.

Disposed leftwardly of the transfer printing roller 105 and in the vicinity of the blower 146 is a solenoid 149 which is connected to one arm of a pivotal lever 150 supported by a shaft 150*a* and having at the end of the other arm a pick-off roller 151 juxtaposed against the peripheral surface of the transfer printing roller 105. About the time the transfer printing roller 105 completes its fifth revolution, the solenoid 149 is actuated to cause the pick-off roller 151 to move into pressing engagement with the transfer printing sheet 107 on the transfer printing roller 105 to strip the leading end of the transfer printing sheet 107 off the peripheral surface of the transfer printing roller 105. At this time, the clamp member 106 is in an inoperative position and the transfer printing sheet 107 is released from its engagement.

The transfer printing sheet 107 stripped off the transfer printing roller 105 as aforementioned is conveyed by a pair of endless belts 155 and 157 trained over rollers 152 and 153 and 154 and 156 respectively, nipped by a pair of delivery rollers 156, 157, has its forward end portion (gripped by the clamp member 106) severed by cutters 158, 159 and is guided by guides 160, 161 in moving on to a duplicate tray 162. The duplicate tray 162 has a cover 163 which is flipped upwardly when a duplicate is introduced thereinto. A waste basket WT is disposed below the cutters 157, 158.

Figure 11:
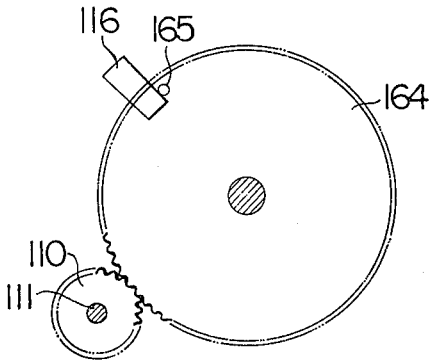
FIG. 11 shows stop means for stopping the photoreceptor in a predetermined position.

FIG. 11 shows means for stopping the photoreceptor drive roller in a predetermined position and controlling the starting position of the photoreceptor 101 by taking the backlash of the gears into consideration. As shown, such means comprises a large diameter gear 164 maintained in meshing engagement with the gear formed integrally with the photoreceptor drive roller 102. The large diameter gear 164 has affixed to one end surface thereof a pin 165 which is adapted to abut against a stopper 166 affixed to an immovable member (not shown) at the terminating stages of the return movement of the photoreceptor 101, in order to ensure that the photoreceptor 101 begins its movement from the original starting position at all times.

Figure 13:
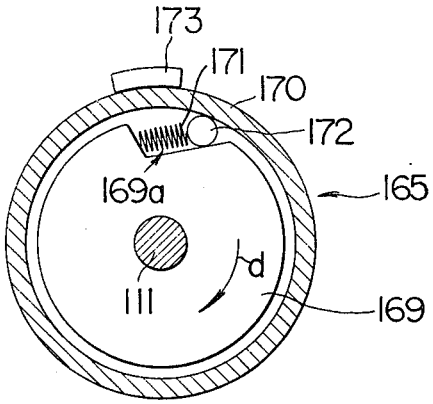
FIG. 13 is a sectional view of one form of one-way clutch.

In order that the photoreceptor 101 may be uniformly charged during its return movement, it is necessary that the rate of return movement thereof be made constant. In FIG. 12, there is shown means for controlling the rate of return movement of the photoreceptor 101 which comprises a gear 166 loosely mounted on a shaft 111 supporting the photoreceptor drive roller 102 and connected to the shaft 111 through a one-way clutch 165. Gear 166 is in meshing engagement with a gear 168 secured to a shaft 167*a* of a motor 167 and rotated by the motor 167 at a constant rate in the direction of an arrow *d* at all times. The one-way clutch 165, which may be of any know construction, comprises, as shown in FIG. 13, an inner wheel 169 formed integrally with gear 166 and fitted in an outer wheel 170 secured to the shaft 111. The inner wheel 169 is formed in its periphery with a wedge-shaped cutout 169*a* which receives therein a ball 172 connected to a spring 171 and urged thereby into engagement with the inner peripheral surface of the outer wheel 170.

When the photoreceptor 101 is rapidly rewound by the rewind roller 104, the outer wheel 170 tends to move in slaved relationship and rotate at a higher rate than the inner wheel 169. However, since the force with which the ball 172 is brought into engagement with the inner periphery of the outer wheel 170 by the spring 171 is increased as the latter rotates in slaved relationship to the return movement of the photoreceptor 101, the outer wheel 170 is unable to rotate at a higher rate than the inner wheel 169 after all. Thus, the rate of return movement of the photoreceptor 101 is controlled by the rate of revolution of the gear 166 driven by the motor 167, so that the rate of its return movement is kept constant from start to finish. The outer wheel 170 has associated therewith a brake applying member 173 which applies the brake to the outer wheel 170 when the influences of the rewinding operation of the rewind roller 104 on the outer wheel 170 is removed, so that the movement of the outer wheel 170 and hence the photoreceptor drive roller 102 and photoreceptor 101 is interrupted. If the movement of the outer wheel 170 is interrupted, the force with which the ball 172 is maintained in pressing engagement with the inner periphery of the outer wheel 170 is reduced, so that the inner wheel 69 idly rotates independently of the outer wheel 170. If the photoreceptor drive roller 102 is driven by the sector gear 109 of the transfer printing roller 105 and rotates in a direction opposite to the direction of arrow *d*, the roller 102 can rotate freely because this direction is opposite to the direction of rotation of the inner wheel 169 and no interference of rotation occurs.

It is to be understood that in the present invention selection of the type of color-selective reflection and transmission filters and selection of developing agents used in combination with the color-selective reflection and transmission filters may be effected freely.

What is claimed is:

1. A color electrophotographic apparatus comprising:

a. an electrophotographic photoreceptor movable in repeated reciprocatory movements between a first locality and a second locality, b. means for urging said electrophotographic photoreceptor toward the first locality, c. exposing means, including a plurality of color-selective reflection and transmission filters, for exposing said photoreceptor at the first locality to an optical image of an original to form an electrostatic latent image on said photoreceptor by using one of said color-selective reflection and transmission filters each time the photoreceptor makes one reciprocatory movement, said filters respectively corresponding to different colors for exposing the photoreceptor to different colors in succession as different filters are used in succession, d. a transfer printing roller having a large diameter portion and a small diameter portion along its outer periphery and rotatable in one direction for successively traversing said second locality, a third locality, and a fourth locality during each cycle of rotation, said large diameter portion including means for mounting a transfer printing sheet thereon and being disposed to bring the sheet into intimate contact with said photoreceptor at the second locality when traversing said second locality, e. means for interlocking the rotation of said roller to said photoreceptor while said large diameter portion of said roller is traversing said second locality, to move the photoreceptor toward the second locality at the same velocity as the peripheral velocity of said large diameter portion against the action of said urging means, thereby effecting transfer printing of an electrostatic latent image on the sheet from the photoreceptor, f. developing means for developing the electrostatic latent image on the transfer printing sheet at said third locality into a visible image by using a developing agent of a color corresponding to the particular color-selective reflection and transmission filter used for exposing, g. means for drying the developed image on the transfer printing sheet at the fourth locality, and h. charging means for uniformly charging the photoreceptor upon completion of transfer printing during its return movement to said first locality caused by said urging means.

2. Apparatus according to claim 1 wherein said interlocking and urging means respectively comprise a photoreceptor drive roller and a rewind roller, and wherein said photoreceptor comprises a belt having opposite ends affixed to said drive and rewind rollers respectively.

3. Apparatus according to claim 1 wherein said photoreceptor comprises a photosensitive drum bearing a photoconductive material layer on its outer periphery.

4. Apparatus according to claim 1 wherein said interlocking means comprises a photoreceptor drive roller, a sector gear connected to said transfer printing roller, and a gear connected to said photoreceptor drive roller, said sector gear being in meshing engagement with said gear.

5. Apparatus according to claim 1 wherein said interlocking means comprises a photoreceptor drive roller, a sector friction wheel connected to said transfer printing roller, and a friction wheel connected to said photoreceptor drive roller, said sector friction wheel being brought into pressing engagement with said friction wheel.

6. Apparatus according to claim 1 wherein said urging means comprises a spring.

7. Apparatus according to claim 5 wherein the transfer printing roller has a pin affixed thereto and the photoreceptor drive roller has an arm, said pin and said arm being adapted to be brought into engagement with each other when the sector friction wheel and the friction wheel of the drive roller are brought into pressing engagement with each other.

* * * * *